United States Patent [19]

Yiin

[11] Patent Number: 5,022,124

[45] Date of Patent: Jun. 11, 1991

[54] CLIP DEVICE

[76] Inventor: Chwen-Chaur Yiin, No. 20, Fu Hsin Hsin Tsun, Kuo Kunag Li, Hwa Lian City, Hwa Lian Hsien, Taiwan, China

[21] Appl. No.: 497,006

[22] Filed: Mar. 20, 1990

[51] Int. Cl.[5] ..... B42F 1/00

[52] U.S. Cl. ..... 24/67.9; 24/552; 24/546

[58] Field of Search ..... 24/67.9, 67.11, 551, 24/552, 553, 554, 555, 545, 546

[56] References Cited

U.S. PATENT DOCUMENTS

| | | | |
|---|---|---|---|
| 380,013 | 3/1888 | Ball | 24/554 |
| 820,361 | 5/1906 | Klein | 24/552 |
| 1,158,940 | 11/1915 | Litt et al. | 24/555 |
| 1,495,297 | 5/1924 | Gerla | 24/49 C |
| 1,753,094 | 4/1930 | Sacerdote | 24/552 |
| 1,753,186 | 4/1930 | Baer | 24/552 |
| 1,778,428 | 10/1930 | Morehouse | 24/563 |
| 2,116,238 | 5/1938 | Harvey | 24/555 |
| 4,300,268 | 11/1981 | Wilson | 24/67.9 |
| 4,480,356 | 11/1984 | Martin | 24/67.9 |
| 4,706,342 | 11/1987 | Yu | 24/67.9 |

FOREIGN PATENT DOCUMENTS

| | | | |
|---|---|---|---|
| 814290 | 9/1951 | Fed. Rep. of Germany | 24/67.9 |
| 3535994 | 4/1987 | Fed. Rep. of Germany | 24/67.9 |
| 281894 | 12/1927 | United Kingdom | 24/67.9 |

*Primary Examiner*—Victor N. Sakran

*Attorney, Agent, or Firm*—Andrus, Sceales, Starke & Sawall

[57] ABSTRACT

A novel clip device comprises a first clipping member with a shape of loop and is made from elastic rod material; a bending member, connected upwardly to one end of the first clipping member; a second clipping member, having the similar shape as the first clipping member, connected to the upper end of the bending member. The second clipping member includes a inner loop member and a outer loop member. The bending member of the clip device provide a larger tolerance for the clip device to swallow the papers.

2 Claims, 5 Drawing Sheets

FIG. 4
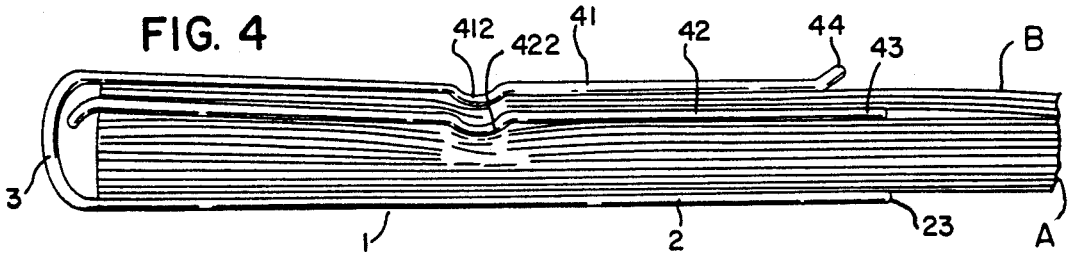
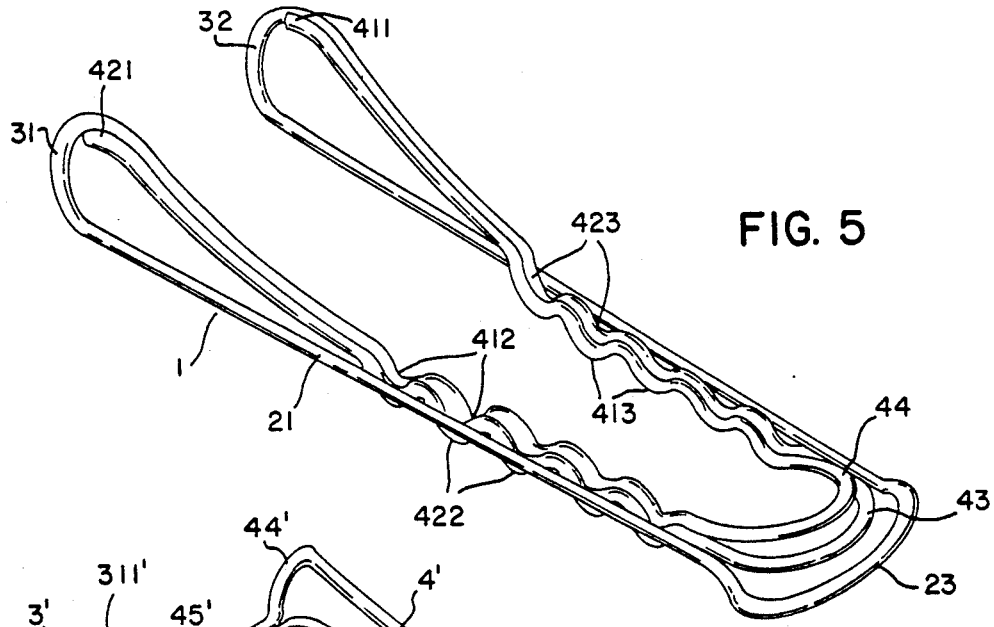
FIG. 5
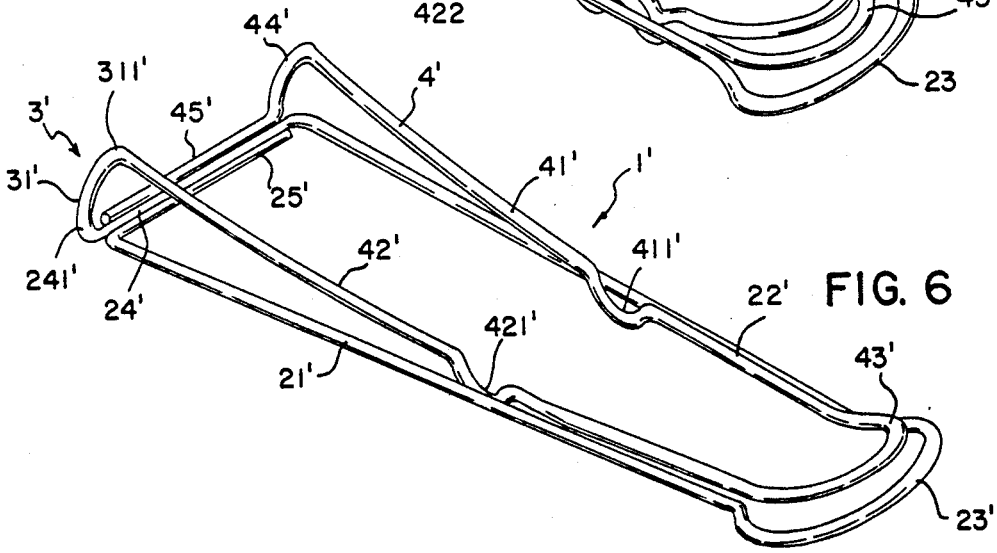
FIG. 6
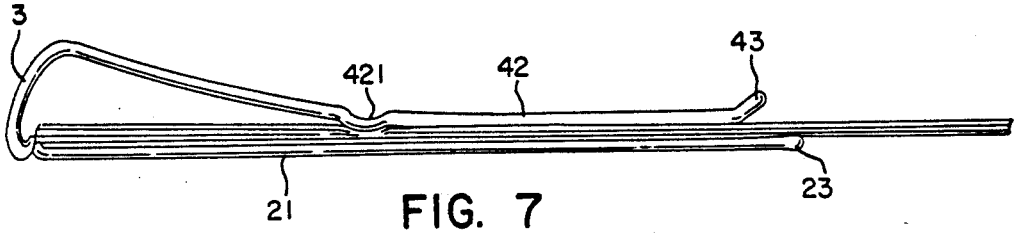
FIG. 7

FIG. 8
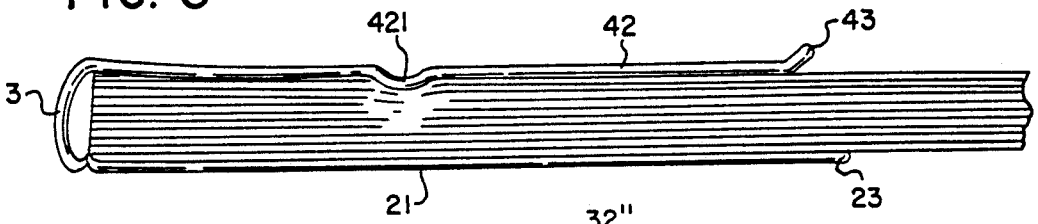
FIG. 9
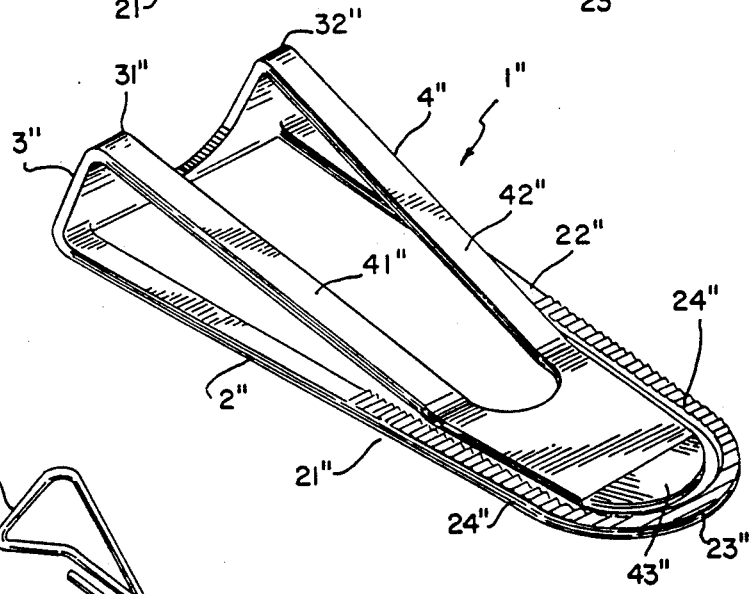
FIG. 10
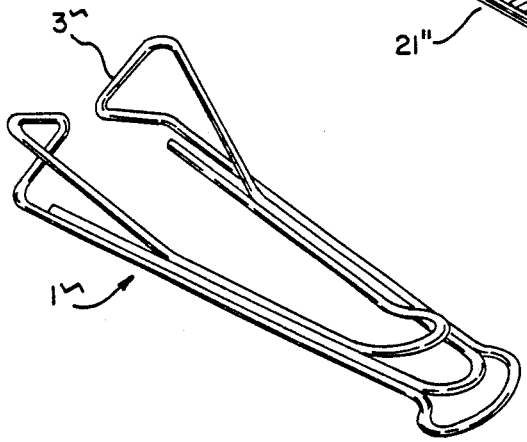
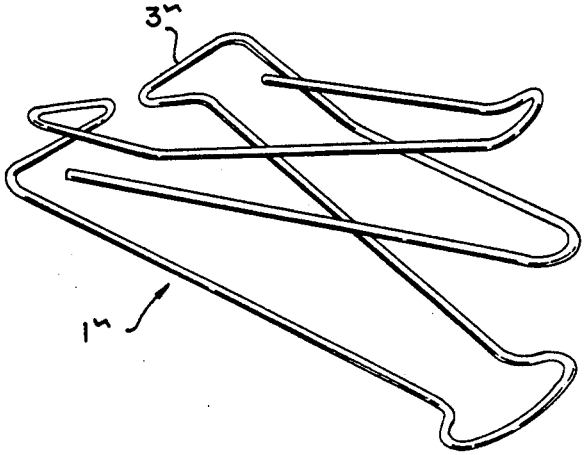
FIG. 11

FIG. 12A
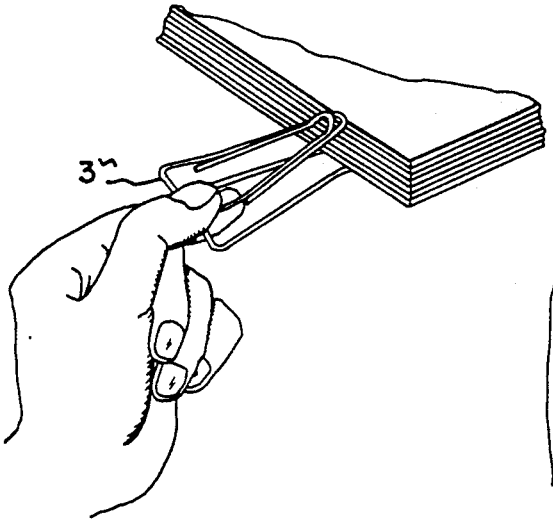
FIG. 12B
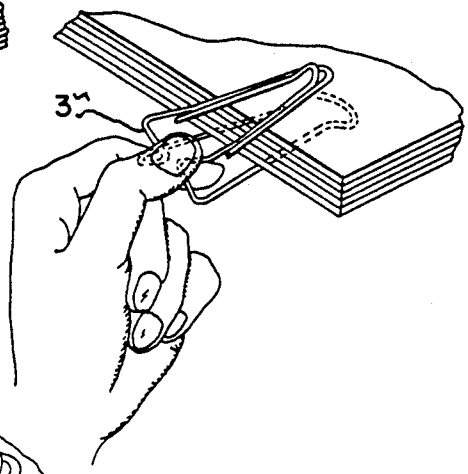
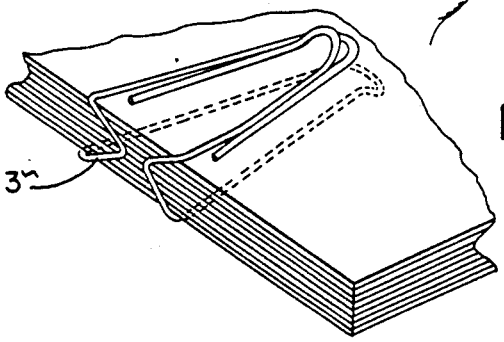
FIG. 12C
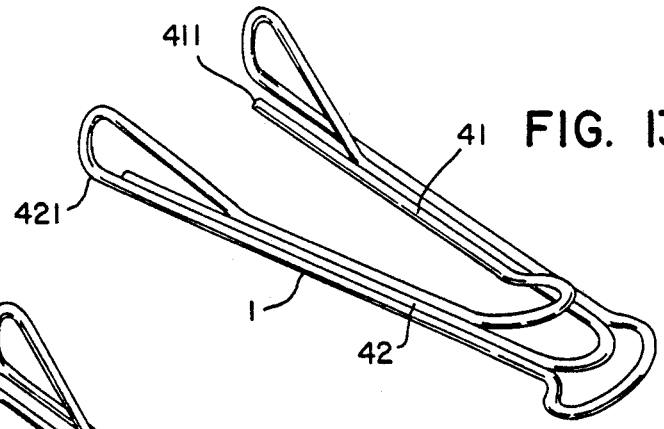
FIG. 13A
FIG. 13B
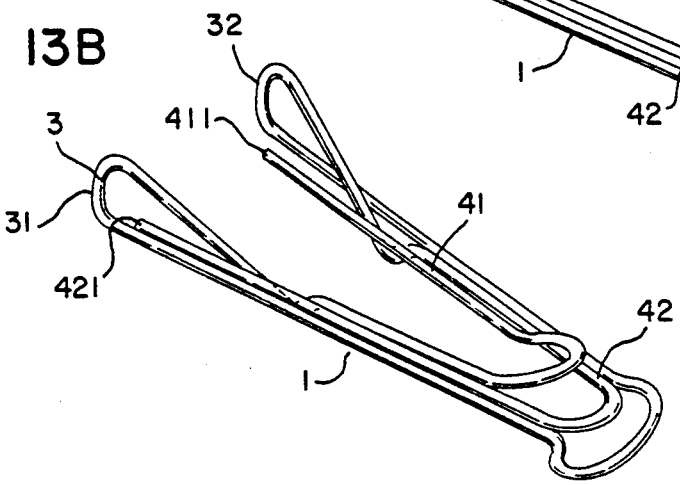

CLIP DEVICE

BACKGROUND OF THE INVENTION

Field of the Invention

The present invention relates to a clip device, in particular to a clip device with a bending member which can provide a larger tolerance in fastening thicker papers.

The conventional clip can not swallow thicker papers since its structure is in a single layer type, a small loop encircling by a larger loop. Its primary design purpose is to be applied to fix few papers, say ten sheets, as we use it to swallow thicker papers, say twenty or thirty sheets of papers. Then, the prior clip will lose its function and break, as shown in FIGS. 10 and 11, two typical conventional clips, failed to swallow thicker papers and is easily dropped out.

By the way, if we want to draw out/insert in a particular sheet of papers within a clipped document, we need to take off the clip first, then draw out/insert in the document, such as inserting in a memorandum or withdraw an unnecessary report or annex. This will spend much time in arranging it. Facing this kind of necessity, none of the prior arts can meet this necessity.

SUMMARY OF THE INVENTION

The purpose of the present invention provides an improved clipping device having a bending member to support the clipping device in order to swallow thicker documents.

The further advantage of the present invention is that it can easily clip two different documents in the same time and effortlessly solve the problems existing in the prior art.

In order to achieve the above mentioned purpose and advantage, the present invention provides a novel clip device having a first clipping member with a shape of loop and made from elastic rod material; a bending member, connected upwardly to one end of said first clipping member; a second clipping member, having the similar shape as said first clipping member, connected to the upper end of said bending member. Said second clipping member includes an inner loop member and an outer loop member. Said inner loop member and outer loop member have a curvature portion thereon in order to provide further downward forces to the document. Said bending member of the said clip device provides a larger tolerance for said clip device to swallow the papers.

Other merits and benefits of the present invention will become apparent as following the detailed description with references to the accompanying drawings proceeds.

BRIEF DESCRIPTION OF THE DRAWINGS

FIG. 4 is another illustrative view of the present invention, swallowing two different documents by inner loop member and outer loop member respectively;

FIG. 5 is first embodiment of the present invention, having several curvature portions of the second clipping member;

FIG. 6 is second embodiment of the present invention, having a single loop member on the second clip member;

FIGS. 7 and 8 show an application of the second embodiment illustrated in FIG. 6;

FIG. 9 is a perspective view of the present invention made from plastic material;

FIG. 10 is a third embodiment of the present invention; having a holder on the bending member;

FIG. 11 is an extendable view of the third embodiment illustrated in FIG. 10;

FIGS. 12*a, b*, and *c* show an application of the third embodiment illustrated in FIG. 10;

FIGS. 13*a* and 13*b* show third embodiment of the present invention; having said first clipping member and second clipping member in the same plane;

DESCRIPTION OF THE PREFERRED EMBODIMENTS

Figure 1:
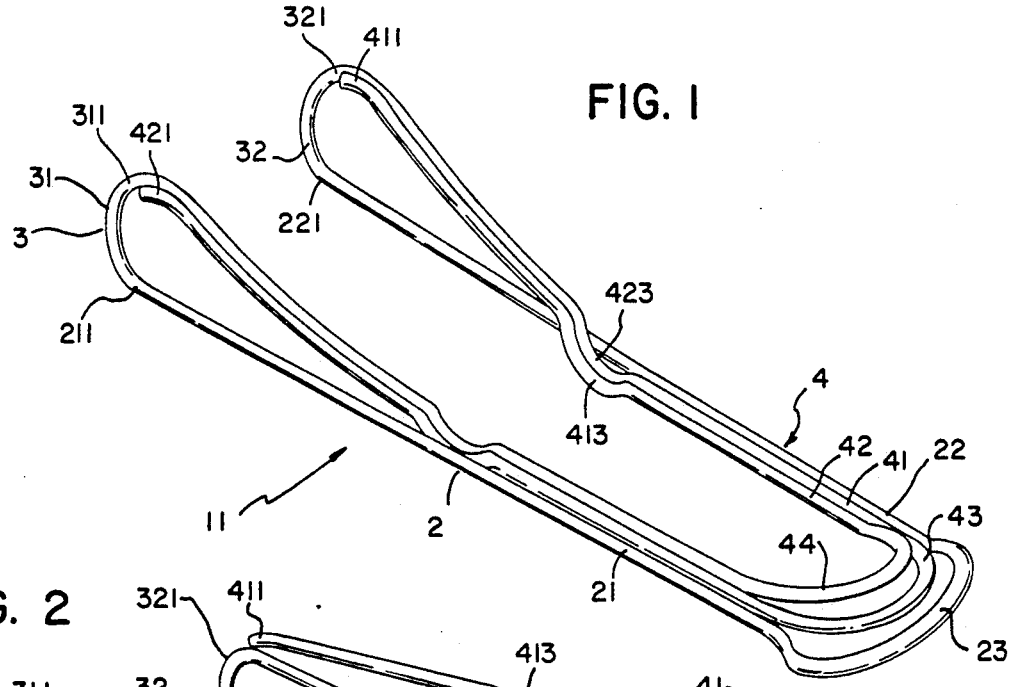
FIG. 1 is the perspective view of the present invention.

Referring to FIG. 1, clip device 1 includes a first clipping member 2, combined with a first rod member 21 and a second rod member 22 and a round portion 23. A bending member 3, including a first arc portion 31 and second arc portion 32, connected individually to the free end 211 and 221 of said first clipping member 2. A second clipping member 4, having a inner loop member 41 and a outer loop member 42, is connected to said free end 311 and 321 of said bending member 3 respectively. Said inner loop member 41 and outer loop member 42 have a curvature portion 422, 423 and 412, 413 respectively thereon. Said free end 421 and 411 of said inner loop member 41 and outer loop member 42 are rest aside of said first arc portion 31 and second arc portion 32 of said bending member 3.

Figure 2:
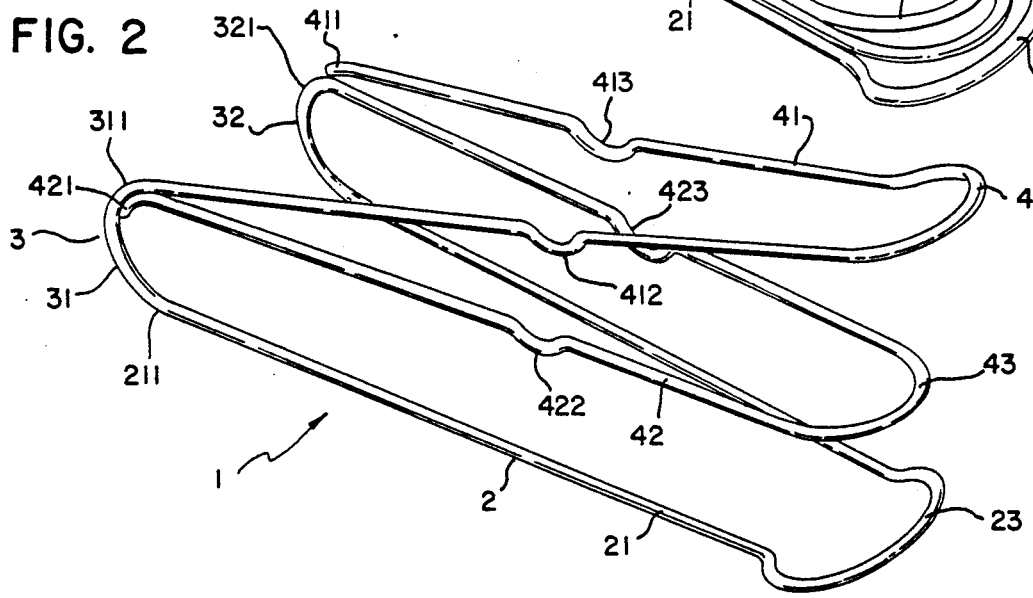
FIG. 2 is another perspective view of the present invention.

Referring to FIG. 2, as we pull the round portion 23, 44 of said first clipping member 2 and said inner loop member 42 to two opposite direction, we will see the maxima opening which said clip device 1 can fasten is the width of said bending member 3. Therefore, said clip device 1 can swallow a large number of sheet safely than the prior arts.

Figure 3:
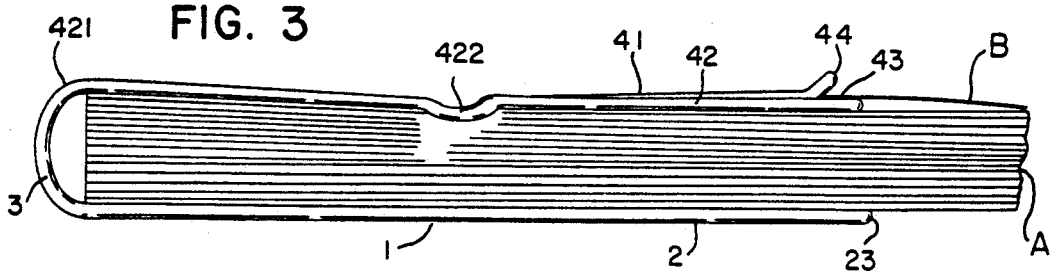
FIG. 3 is the illustrative view of the present invention, swallowing thicker documents.

FIGS. 3 and 4 will illustrate the advantages of the present invention. We can find that said curvature portion 422, 423 and 412, 413 further provide a downward force to fasten the papers, as shown in FIG. 3.

FIG. 4 indicates that the present invention can clip two different groups of papers, say group A and group B. We can draw out group A or B separately and will not break the order of another.

FIG. 5 illustrates a first embodiment where said second clipping member 4 has a plurality of curvature portions for clipping the papers.

FIG. 6 is second embodiment of the present invention, said clip device 1' has only a single loop member 41' on second clip member 4'. Said second embodiment is slightly different to the prior clip device 1 in structure. We can find easily that said clip device 1' includes a first clipping member 2', said first clipping member 2 comprising a first rod member 21' and a second rod member 22' and a round portion 23', a first transverse rod member 24' and a second transverse rod member 25'. A bending member 3', including an arc portion 31' is connected to one end 241' of said second transverse rod member 24' of said first clipping member 2'. Said second transverse rod member 25' of said first clipping member 2' does not engage with said bending member 3' and just rests aside said first transverse rod member 24' of said first clipping member 2'. A second clipping member 4', having a first rod member 41' and a second rod member 42' and a round head portion 43', is connected to said end 311' of said bending member 3'. Said second clipping member 4' also has an arc portion 44' which is identical with said arc portion 31' of said bending member 3'. Said second clipping member 41' has curvature portions 411', 421' thereon. A transverse rod member 45' of said clipping member 4' rests aside said transverse rod member 24' of first clipping member 2'. This embodiment is a single stack of layer clip device and is used to swallow a single document.

FIGS. 7 and 8 are an application of the second embodiment illustrated in FIG. 6.

FIG. 9 illustrates a modified embodiment which is similar to the embodiment shown in FIG. 6. Said modified embodiment is made from plastic material and directly formed within a mold. Said clip device 1'' has a first clipping member 2'', constructed by two elongate plate members 21'' and 22'' and also a round head portion 23''. Said elongate plate member 22'', 23'' has trigger keys 24'' in the front area and is used to increase the holding force of said clip device 1''. A bending member 3'', having a shape of plate with an opening thereon, is connected to said first clipping member 2'' at 221'', 231''. A second clipping member 4'', constructed by two elongate plate member 41'' and 42'' and also a round head portion 43''. Said round head portion 43'' has a much larger area as compared with said round head portion 23'' of said first clipping member 2'' and also has trigger keys 44'' thereunder. Since this modified embodiment is made with plastic material, therefore it can be manufactured easily through mass production.

FIGS. 10, 11 describe another modified structure of a clipping device for the present invention. The most difference resides on the bending member 3~. In the prior embodiments, said bending member 3, 3' or 3'' is in a form of an arc or a plate, see FIGS. 1, 5, and 9. Basically, it is not suitable to hold in some manner, since there is no supporter for fingers in said bending members. Under this circumstance, the inventor slightly change the arc or plate type bending member into a new form with two transverse V-type rod member 31~, 32~ with angle opposed each other.

From FIGS. 12*a*, 12*b* and 12*c*, we find modified transverse V-type bending member 3~provides a holder for user's fingers. No doubt, it is more user friendly.

Another alternations of the present invention are shown in FIGS. 13*a*, 13*b*. Said free end 421 and 411 of said inner loop member 41 and outer loop member 42 are rest in the same plane of said first clipping member 2. By doing this, said free ends 421, 411 will provide a further clipping force to the documents. In FIG. 13*b* indicates there is only a pair of curvature portion 422, 412.

Figure 14:
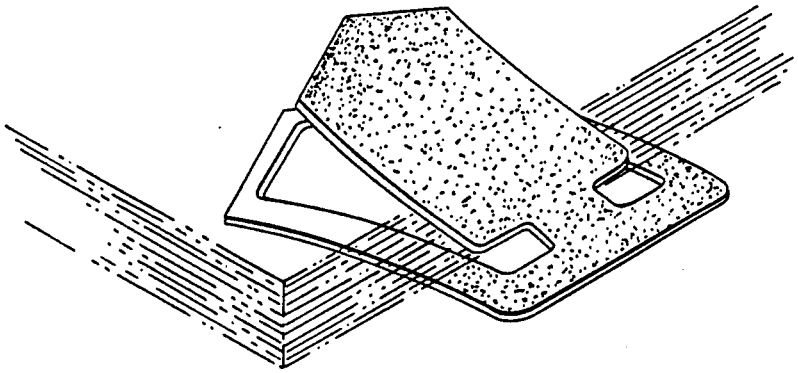
FIG. 14 PRIOR ART
FIGS. 14 and 15 are the illustrative view of the prior arts.
Figure 15:
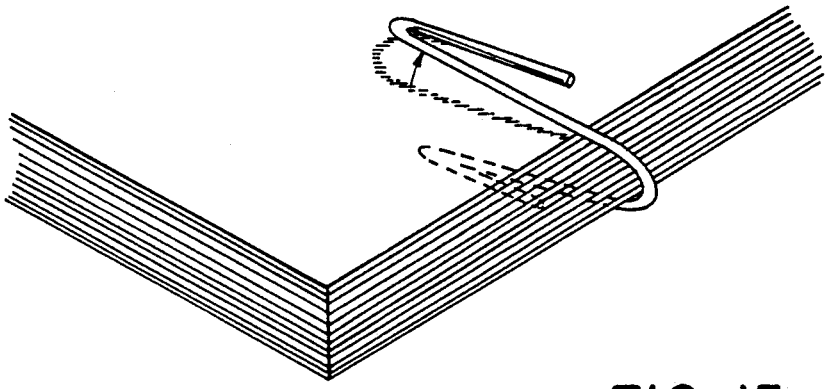
FIG. 15 PRIOR ART

FIGS. 14 and 15 are the illustrative view of the prior arts, we find those clips are failed to finish their function as meet those thick documents.

While the present invention has been explained in relation to its preferred embodiments, it is to be understood that various modifications thereof will become apparent to those skilled in the art upon reading this specification. Therefore, any modifications to the present invention shall be covered by the appended claims.

What I claim is:

1. A clip device comprising:

a first clipping member (2'), said first clipping member having a first rod member (21'), as second rod member (22'), a rounded portion (23') intermediate said first and second rod members (21', 22') of said first clipping member, a first transverse rod member (24') and a second transverse rod member (25') connected to the ends of said first and second rod members (21', 22');

a bending member (3') having an arc portion (31') connected by one end to one end of said first transverse rod (24') of said first clipping member; and a second clipping member (4'), having a first rod member (41'), a second rod member (42'), a transverse rod member (45') and a round head portion (43') intermediate said first and second rod members (41', 42') of said second clipping member, said second clipping member being connected to a second end of said bending member (3'), said second clipping member further comprising an arc portion (44') which is identical with said arc portion (31') of said bending member (3') and to which said transverse rod (45') of said second clipping member is connected, said first transverse rod member (24') and a second transverse rod member (25') of said first clipping member and said transverse rod (45') of said second clipping member resting in proximity.

2. A clip device as recited in claim 1, wherein said second clipping member has curved portions (411', 412') along said rod members and providing a clipping force to documents inserted in the clip device.

* * * * *